United States Patent [19]

Gunther

[11] 4,352,513

[45] Oct. 5, 1982

[54] TOGGLE LATCH WITH SPRING CATCH

[75] Inventor: Conrad J. Gunther, Uniondale, N.Y.

[73] Assignee: Dzus Fastener Co., Inc., West Islip, N.Y.

[21] Appl. No.: 130,021

[22] Filed: Mar. 13, 1980

[51] Int. Cl.[3] ..... E05C 5/02

[52] U.S. Cl. ..... 292/113; 292/107; 292/DIG. 49

[58] Field of Search ..... 292/87, 107, 113, 209, 292/247, DIG. 31, DIG. 49

[56] References Cited

U.S. PATENT DOCUMENTS

| | | | |
|---|---|---|---|
| 417,619 | 12/1889 | Woodard | 292/87 |
| 2,192,160 | 2/1940 | Tinnerman | 292/76 X |
| 2,303,854 | 12/1942 | Lyon | 292/76 |
| 3,602,723 | 8/1971 | Swanson | 292/247 X |
| 3,831,224 | 8/1974 | MacMaster et al. | 292/113 X |

FOREIGN PATENT DOCUMENTS

| | | | |
|---|---|---|---|
| 2261396 | 9/1975 | France | 292/113 |
| 645297 | 1/1979 | U.S.S.R. | 292/113 |

*Primary Examiner*—Richard E. Moore

*Attorney, Agent, or Firm*—Kane, Dalsimer, Kane, Sullivan & Kurucz

[57] ABSTRACT

A toggle latch for fastening two members together. The latch includes a base adapted to be coupled to one member to be fastened and a draw bar connected to the base and having a free end for engagement with the other member to be fastened. A lever having an opening therein is connected to the draw bar and the base and is pivotable to shift the draw bar between open and closed positions to unfasten and fasten the two members respectively. A spring catch is provided having an anchor portion affixed to the lever. A resilient intermediate portion of the spring catch extends from the anchor portion and terminates in an actuator arm projecting through the opening in the lever. The resilient intermediate portion biases the actuator arm in one direction and permits the arm to be moved in a second direction. At least one finger is on the spring catch in position to engage with one of the base and draw bar when the lever is pivoted to the closed position and the actuator arm is biased in one direction to prevent pivoting of the lever to the open position and to be disengaged therefrom when the actuator arm is moved in the second direction permitting the lever to be pivoted to the open position.

6 Claims, 6 Drawing Figures

TOGGLE LATCH WITH SPRING CATCH

BACKGROUND OF THE INVENTION

There are a variety of different types of toggle latches presently on the market and some designs recognize the need for a safety catch to prevent accidental opening of the latch. This feature is particularly useful in heavy duty areas such as where the latch is used to retain large containers and when containers are roughly handled.

A common way to maintain the latch in the closed position so that the conventional lever is not accidentally displaced causing the latch to open is to use a wire to attach the opening lever of the toggle assembly to the fixed portion and maintain a positive locked condition. When the lock is to be opened, the wire must be unwound or cut. Unwinding of the wire can be a time consuming procedure both in opening and refastening of the latch. Similarly, if the latch is to be refastened, the cut wire can naturally not be reattached and a new wire has to be used if one is available.

Accordingly, there is a need for a quick and efficient safety catch for a toggle latch which can be used repeatedly and which is inexpensive to manufacture and can be assembled to existing toggle latches or can be built into newly formed latches. Ease of operation and cost are important factors, particularly when dealing with a mass produced inexpensive item such as a toggle latch. Examples of several types of toggle latches are in U.S. Pat. Nos. 1,090,634 and 3,127,205. An example of a toggle latch with a safety catch is present in U.S. Pat. No. 3,519,298, and from that reference, it is clear that the need for a toggle type of latch is desirable and necessary. Accordingly, improvements in this area would be extremely valuable and desirable in the field of manufacturing and use of toggle type latches. An example of a recent development in this respect is present in a commonly assigned patent application Ser. No. 832,153 filed Sept. 12, 1977.

SUMMARY OF THE INVENTION

With the above background in mind, it is among the primary objectives of the present invention to provide an improved safety catch in the form of a spring catch which is inexpensively manufactured as part of a conventional type of toggle latch to act quickly and efficiently as a safety catch for the latch to retain it in the locked position.

The spring catch is designed so that it can be easily shiftable to the unlocked position permitting opening of the toggle latch. It can be used repeatedly to relock the toggle latch in position when the latch is reclosed.

The spring catch of the present invention is designed to be integrally formed as part of the toggle latch or mounted to a conventional toggle latch is an easy and efficient manner during manufacture or thereafter. The spring catch is formed of a single piece of inexpensive spring material and acts as a resilient stop which, when in relaxed position, holds the lever portion of the toggle latch in locked position and when resiliently displaced releases the lever for opening of the latch. It automatically snaps into locking position when the lever arm is closed.

The spring catch is designed so that it has an anchor portion for quickly and efficiently affixing the catch to a lever arm, a resilient intermediate portion which can be U-shaped in configuration and weakened, if desired, to facilitate the resilient movement in the catch, an extending actuator arm with a readily accessible finger gripping portion to quickly operate the catch, and a projecting finger portion to interengage and release portions of the base or draw bar of the toggle latch to facilitate the locking and unlocking actions.

The spring catch portion of the toggle latch of the present invention is simple in construction and assembly and therefore is inexpensive to manufacture and assemble to an existing type of toggle latch. The spring catch is designed so that it can be entirely mounted to the lever portion of the pivotable lever portion of the toggle latch. In fact, the majority of the structure can be mounted to the underside of the lever arm and in an unexposed position when the toggle latch is closed with only a small portion of the catch extending through the lever for facilitating actuation of the catch. It is also contemplated that the catch could be integrally formed with the lever arm.

The toggle latch of the present invention is designed to be formed of a common type of material such as stainless steel or the like and the spring catch be formed of a resilient spring steel material or any conventional well known substitute therefor.

In summary, a toggle latch is provided for fastening two members together. The latch includes a base adapted to be coupled to one member to be fastened. A draw bar is connected to the base and has a free end to engage with the other member to be fastened. A lever on the toggle latch has an opening therein and is connected to the draw bar and the base and is pivotable to shift the draw bar between open and closed positions to unfasten and fasten the two members respectively. A spring catch is provided having an anchor portion affixed to the lever. A resilient intermediate portion of the spring catch extends from the anchor portion and terminates in an arcuate arm projecting through the opening in the lever. The resilient intermediate portion biases the actuator arm in one direction and permits the arm to be moved in a second direction. At least one finger is on the spring catch in position to engage with one of the base and draw bar when the lever is pivoted to the closed position and the actuator arm is biased in the one direction to prevent pivoting of the lever to the open position and to be disengaged therefrom when the actuator arm is moved in the second direction permitting the lever to be pivoted to the open position.

With the above objectives among others in mind, reference is made to the attached drawings.

DETAILED DESCRIPTION

Figure 1:
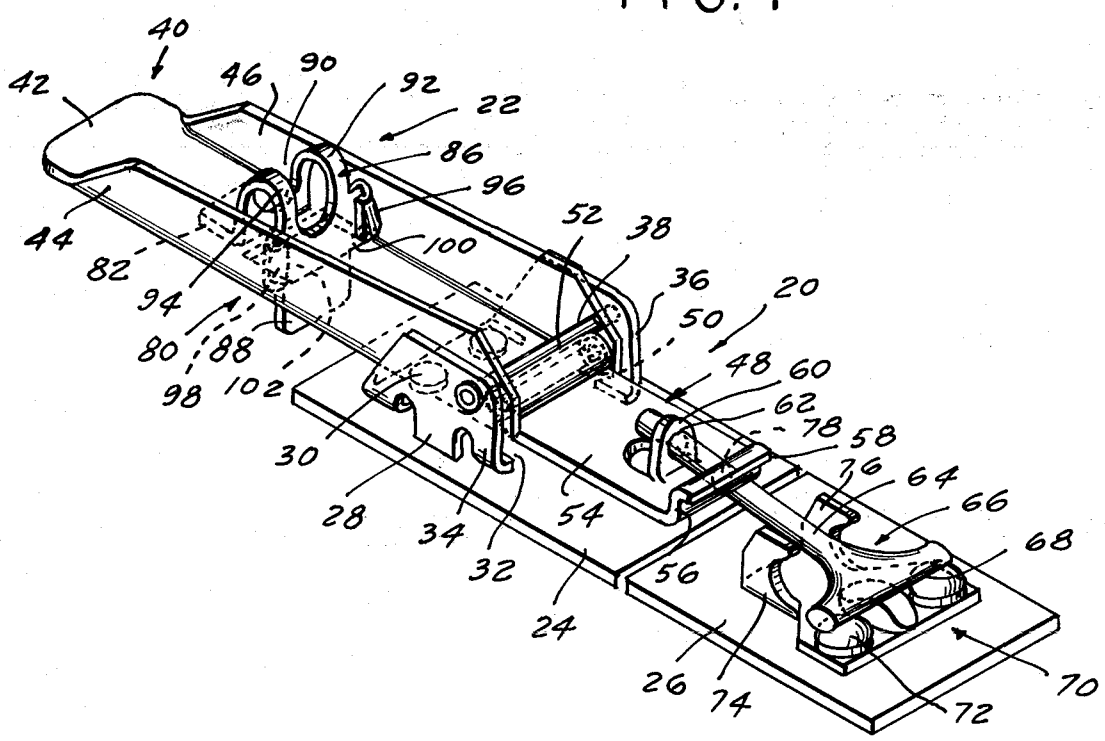
FIG. 1 is a perspective view of the toggle latch of the invention in the open position and mounted on two members to be fastened.

Toggle latch 20 of the invention is depicted in the drawings with spring catch 22 mounted thereon and the latch is mounted in position to fasten members 24 and 26 together.

Latch 20 includes a base portion 28 which is mounted to member 24 by conventional means such as rivets 30. Base portion 28 includes a flat central bottom 32 and a pair of spaced opposing side walls 34 and 36. The side walls 34 and 36 extend upwardly and away from the member 24.

A pivot pin 38 is attached at one end to wall 34 and at the other end to wall 36 in a conventional manner such as by riveting. Rotatably mounted on pivot pin 38 is a lever 40 which has a substantially flat central portion 42 and two parallel flanges 44 and 46 substantially extending along the length of the lever along the longitudinal edges. The flanges 44 and 46 have openings through which the pivot pin 38 passes. The openings have a slightly larger diameter than pivot pin 38 so that there is free rotation of the lever about the pivot pin to permit the desired pivotal movement.

A draw bar 48 is mounted to the lever arm 40 by means of an axle 50 affixed adjacent the end of both flanges 44 and 46. Axle 50 is substantially parallel to pivot pin 38 and slightly spaced therefrom. The axle extends through a tubular end portion 52 of the draw bar which is rolled into the hollow tubular configuration. Axle 50 is affixed to flanges 44 and 46 by riveting or other conventional means. As lever 40 rotates above about pivot pin 38 it carries axle 50 and tubular end portion 52 of the draw bar reciprocally back and forth beneath pivot pin 38. Thus, in this manner, rotational movement of the lever results in corresponding slight vertical movement of draw bar 48 and greater longitudinal movement of the draw bar 48.

A flat body portion 54 of the draw bar 48 extends from tubular end portion 52 and terminates in an upstanding tab 56 having a lateral locking lip 58.

The central portion of body 54 is displaced upward to form a receiving loop 60 with a threaded aperture 62 therein. The threaded aperture 62 provides for adjustment of a threaded shank 64 of a locking tang 66 extending from the end of the body 54. The locking tang 66 includes a cross bar 68 at its free end for engagement with a keeper 70.

As shown, keeper 70 is conventional and is fastened to member 26 by convenient means such as rivet 72. It has a pair of upstanding spaced claws or prongs 74 and 76 which permit movement of shank 64 of tang 66 therebetween in a reciprocal manner. The surface of claws 74 and 76 facing cross bar 68 are arcuate to form a capturing surface for engagement with the cross bar 68 when the draw bar 48 is pulled longitudinally into engagement with claws 74 and 76 as lever 40 is directed into the closed position in overlying relationship with respect to the draw bar. Shank 64 has a threaded end which extends into threaded interengagement with threaded aperture 62 of loop 60 whereby adjustment of the length of the tang 66 and accordingly the draw bar 48 is provided to accommodate for distance variation members 24 and 26. The shank also passes through a larger diameter aperture 78 in upstanding tab 56 to avoid interference between the components of the draw bar 48.

A spring catch 80 is mounted to the underside of lever 40 intermediate the edges of central portion 42. The spring catch in the depicted embodiment is formed of a single unitary piece of somewhat resilient material such as spring steel or any convenient well known substitute therefor. It includes an anchor portion 82 which is a substantially flat element affixed directly to the underside of lever 40 in a conventional manner such as by rivet 84. A U-shaped curved intermediate portion 86 extends from anchor portion 82 and terminates in an extending actuator arm 88. The U-shaped intermediate portion 86 is interrupted by a slot 90 which has a dual purpose. The slot weakens the intermediate portion 86 which takes the form of a pair of spaced U-shaped legs 92 and 94. This enhances the resilient properties of the spring catch 22 and accordingly makes it easier to operate in the manner described below. Additionally, the slot 90 provides a recess for introduction of shank 64 of tang 66 when the lever 40 is moved into the closed position and spring catch 80 engages with locking lip 58.

The locking action is achieved by means of a pair of projecting fingers 96 and 98 extending from the edges of the catch along the portion where intermediate portion 86 and actuator arm 88 interconnect. The finger 96 and 98 are located on the underside of lever central portion 42 between the flanges 44 and 46. The number of engaging fingers is a matter of choice. One is sufficient although there are two shown in the depicted form and a greater number can also be used.

Actuator arm 88 extends through opening 100 in central portion 42 of lever 40. The resulting projecting portion 102 of the actuator arm forms a relatively enlarged flat finger gripping surface to facilitate operation of the spring catch in conjunction with toggle latch 20. The resilient nature of safety catch 80 tends to force actuator arm 88 away from anchor portion 82 and into engagement with the adjacent edge of aperture 100 in the lever arm. In this position, the resilient spring catch 80 is slightly biased so that it resides in relatively stable position until the lever 40 is closed.

Figure 2:
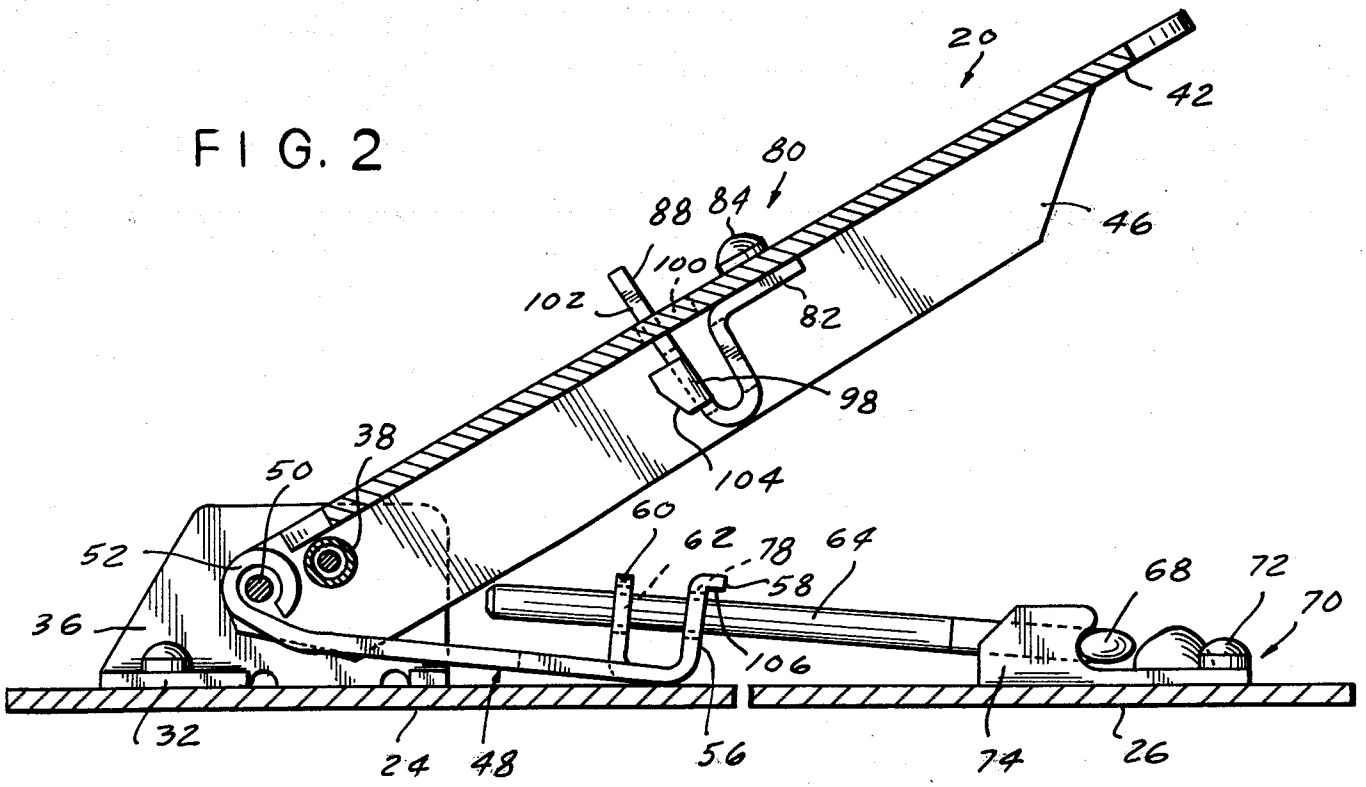
FIG. 2 is a sectional side elevation view thereof with the lever arm in the process of being shifted to the closed position.
Figure 6:
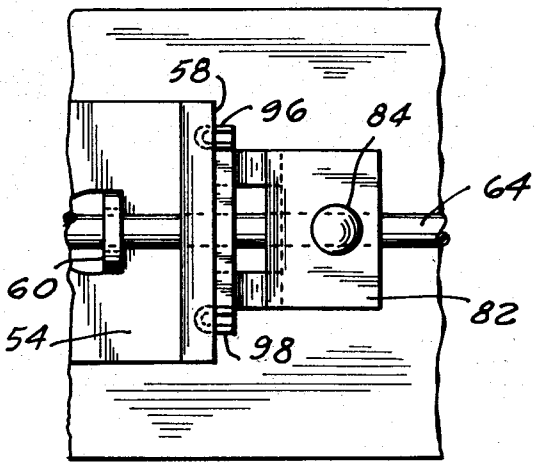
FIG. 6 is a fragmentary sectional top view thereof taken along the plane of line 6—6 of FIG. 3.
Figure 3:
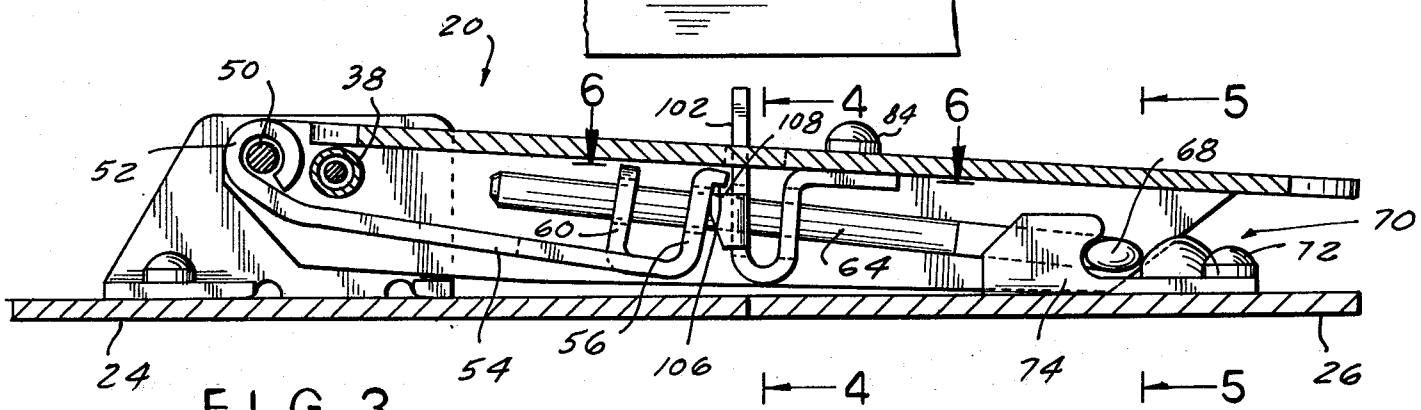
FIG. 3 is a sectional side elevation view thereof with the lever arm fully closed and held in that position by the spring catch.
Figure 4:
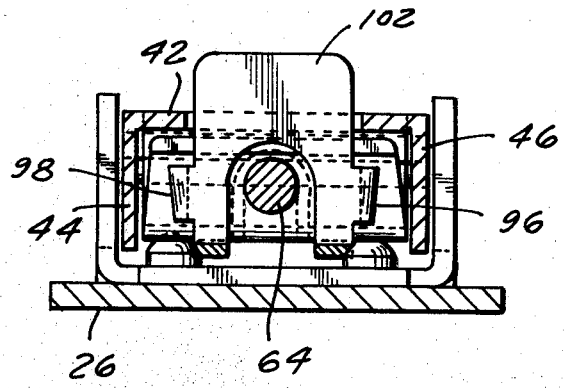
FIG. 4 is a sectional end view thereof taken along the plane of line 4—4 of FIG. 3.
Figure 5:
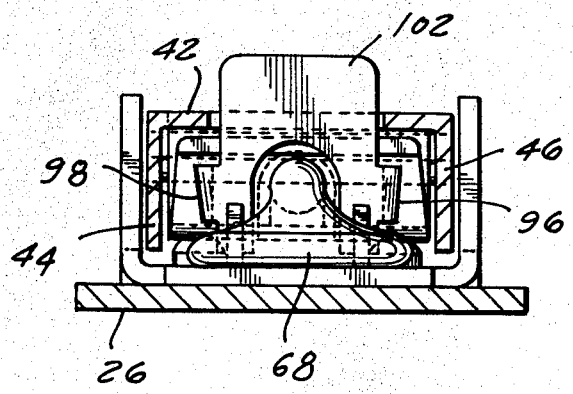
FIG. 5 is a sectional end view thereof taken along the plane of line 5—5 of FIG. 3.

In use, the keeper 70 is mounted to member 26 and base 28 is mounted to member 24 as described above. Suitable adjustments are made by shifting the position of the draw bar tang 68 in a longitudinal direction through use of its threaded interengagement with threaded aperture 62. The adjustment is such that the draw bar will be free of claws 74 and 76 in the open position as shown in FIG. 1 to permit members 24 and 26 to be separated from one another and in engagement with claws 74 and 76 in the closed and locked position as depicted in FIGS. 3–6 to retain members 24 and 26 in locked interengagement. Lever 40 is then moved toward the closed position by pivoting the lever arm about pivot pin 38 as depicted in FIG. 2 which draws cross bar 68 into captured interengagement with the arcuate inner surfaces of claws 74 and 76. The locking action is completed as shown in FIG. 3 by directing the lever arm fully downward into overlying relationship with the draw bar and keeper assembly until fingers 98 and 96 are in position to interfere with locking lip 58. They engage the locking lip forcing actuator arm 88 and fingers 96 and 98 toward anchor portion 82. The resilient nature of spring catch 80 permits this movement. The movement continues during the downward movement of the lever and is aided by the beveled lower portion 104 of each finger until the fingers pass beyond locking lip 58. At that time, the resilient nature of actuator arm 88 will cause it to snap back into position against the adjacent surface of opening 100 and at the same time causing the fingers to snap into locked position beneath locking lip 58. Locking engagement is provided by interference between the undersurface 106 of the locking lip and the upper surface 108 of each finger 96 and 98. In this position, it is not possible to open the latch 20 accidentally or otherwise without shifting spring catch 80 to the unlocking position.

Unlocking is achieved in a quick and efficient manner by grasping exposed finger gripping portion 102 of the actuator arm 88 and pressing the actuator arm toward anchor portion 82. The actuator arm is shifted until the engaging surface of the fingers and the locking lip are free of one another at which time the lever can be pivoted back to the open position in the manner shown in FIGS. 2 and 1 progressively. This movement will free the draw bar from the keeper and permit members 26 and 24 to be separated.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. In a toggle latch for fastening two members together including a base adapted to be coupled to one member to be fastened, a draw bar connected to the base and having a free end to engage with the other member to be fastened, a lever having an opening therein connected to the draw bar and the base and pivotable to shift the draw bar between open and closed positions to unfasten and fasten the two members respectively the lever being pivotally mounted to the base and the draw bar so that when it is pivoted to the closed position it is shifted into overlying position with respect to the draw bar and the base and when it is pivoted to the open position it is pivoted up and away from the draw bar and the base, the improvement comprising; a one piece integral spring catch having an anchor portion affixed to the lever, a resilient intermediate portion extending from the anchor portion and terminating in an arcuate arm projecting through the opening in the lever, the resilient intermediate portion biasing the actuator arm in one direction and permitting the arm to be moved in a second direction, at least one finger on the spring catch in position to automatically engage with one of the base and draw bar when the lever is pivoted to the closed position and the actuator arm is biased in the one direction to prevent pivoting of the latch to the open position and to be disengaged therefrom when the actuator arm is moved in the second direction permitting the lever to pivot to the open position, the intermediate portion being U-shaped and terminating in two ends with the anchor portion extending from one end and the actuator arm extending from the other end, the actuator arm including a finger gripping portion extending through the opening in the lever to facilitate grasping and movement thereof, and the intermediate portion having a central slot between two spaced U-shaped legs to facilitate provision of sufficient resilience for the spring catch and accommodating a portion of the toggle latch when the lever is shifted to the closed position.

2. The invention in accordance with claim 1 wherein there are two spaced fingers extending laterally with respect to the actuator arm to engage with receiving surfaces on the toggle latch when the lever is shifted to the closed position and the actuator arm is biased in the one direction so as to prevent the lever arm from shifting to the open position.

3. The invention in accordance with claim 1 wherein the anchor portion is substantially flat and extends substantially perpendicularly from the interconnected leg of the U-shaped intermediate portion and substantially perpendicularly with respect to the actuator arm and is adapted for mounting to the undersurface of the lever adjacent to the opening therein.

4. The invention in accordance with claim 1 wherein the draw bar contains a projecting lip in position for interengagement with the at least one finger on the spring catch when the actuator arm is biased in the one direction to provide interengagement therebetween and preventing shifting of the lever arm to the open position, and when the actuator arm is moved in the second direction the at least one finger will be moved out of alignment with the lip on the draw bar freeing the lever to pivot to the open position.

5. The invention in accordance with claim 1 wherein the spring catch is formed of spring steel material and the remainder of the toggle latch is formed of stainless steel material.

6. The invention in accordance with claim 1 wherein the anchor portion of the spring catch is riveted to the lever.

* * * * *